United States Patent [19]

Manoly et al.

[11] Patent Number: 4,947,467

[45] Date of Patent: Aug. 7, 1990

[54] TRAVELING-WAVE TUBE SLOW-WAVE STRUCTURE WITH INTEGRAL CONDUCTIVELY-LOADED BARREL AND METHOD OF MAKING SAME

[76] Inventors: Arthur E. Manoly, 26630 Basswood Ave., Rancho Palos Verdes, Calif. 90274; Otto Sauseng, 1308 Stonewood Ct., San Pedro, Calif. 90732; John T. Benton, 5401 Cerulean Ave., Garden Grove, Calif. 92645

[21] Appl. No.: 172,513

[22] Filed: Mar. 24, 1988

[51] Int. Cl.[5] ..... H01J 25/34

[52] U.S. Cl. ..... 315/3.5

[58] Field of Search ..... 315/3.5, 39.3; 29/600

[56] References Cited

U.S. PATENT DOCUMENTS

| | | | |
|---|---|---|---|
| 3,972,005 | 7/1976 | Nevins, Jr. et al. | 330/43 |
| 4,347,419 | 8/1982 | Jasper, Jr. | 29/600 |
| 4,572,985 | 2/1986 | Kuntzmann et al. | 315/3.5 |

*Primary Examiner*—Theodore M. Blum

*Attorney, Agent, or Firm*—Terje Gudmestad; Paul M. Coble; Wanda K. Denson-Low

[57] ABSTRACT

An integral conductively-loaded encasing barrel for a slow-wave structure is formed by electrical discharge machining a plurality of circumferentially spaced longitudinally extending slots in the interior surface of the barrel. The machining discharge is established between a portion of the interior surface of the barrel and an electrode wire which is moved in a longitudinal direction within the barrel while the barrel is moved in a preselected manner in a plane transverse to the direction of movement of the wire. A subassembly comprising a slow-wave structure and a plurality of longitudinally disposed electrically insulating support rods in contact with and circumferentially spaced about the outer surface of the slow-wave structure is secured within the barrel with the support rods disposed within respective machined slots. The radially inwardly projecting portions of the barrel between the slots provide integral conductive loading for the slow-wave structure.

9 Claims, 2 Drawing Sheets

TRAVELING-WAVE TUBE SLOW-WAVE STRUCTURE WITH INTEGRAL CONDUCTIVELY-LOADED BARREL AND METHOD OF MAKING SAME

TECHNICAL FIELD

This invention relates to traveling-wave tubes, and more particularly relates to a traveling-wave tube slow-wave structure assembly in which the encasing barrel has an integral shield formed therein for loading the structure.

BACKGROUND OF THE INVENTION

In traveling-wave tubes a stream of electrons is caused to interact with a propagating electromagnetic wave in a manner which amplifies the electromagnetic energy. In order to achieve the desired interaction, the electromagnetic wave is propagated along a slow-wave structure, such as an electrically conductive helix wound around the path of the electron stream. The slow-wave structure provides a path of propagation for the electromagnetic wave which is considerably longer than the axial length of the structure so that the traveling wave may be made to effectively propagate at nearly the velocity of the electron stream. Slow-wave structures of the helix type are usually supported within an encasing barrel by means of a plurality (usually three) of equally circumferentially spaced electrically insulating rods positioned around the helix and within the barrel.

In order to reduce the variation in phase velocity as a function of frequency and thereby increase the operating bandwidth, slow-wave structures have been loaded with longitudinally extending conductors projecting radially inwardly from the encasing barrel. One prior technique for producing such conductive loading is to form the barrel by wrapping a conductive wire about the slow-wave structure and its support rods, thereby producing a triangulation effect in which conductive material is located closer to the slow-wave structure in regions between the rods. Another prior technique, disclosed in U.S. Pat. No. 3,972,005 to Nevins, Jr., et al, involves mounting a plurality of individual radially inwardly projecting conductive vane members between the support rods.

As traveling-wave tube operating frequencies increased, required dimensions for slow-wave structures employed in such tubes have become smaller and smaller. The aforementioned conductive loading methods are extremely difficult to carry out and have not been satisfactory for small-sized slow-wave structures, such as those operating at millimeter wavelengths.

SUMMARY OF THE INVENTION

It is an object of the present invention to provide a traveling-wave tube slow-wave structure assembly especially suitable for slow-wave structures of very small size wherein the encasing barrel is conductively loaded to enable a large bandwidth to be achieved.

It is a further object of this invention to provide a simple, inexpensive and reliable method by which a slow-wave structure encasing barrel may be manufactured to include therein conductive loading for the slow-wave structure.

It is another object of the invention to provide a slow-wave structure assembly for a traveling-wave tube in which integral conductive loading is provided for the encasing barrel, thereby enhancing heat transfer out of the assembly.

In a method according to the invention for fabricating an encasing barrel for a slow-wave structure, an electrically conductive tubular barrel is mounted in electrical discharge machining apparatus with a machining electrode positioned within the barrel. An electrical discharge is established between the electrode and a portion of the interior surface of the barrel while relative movement is provided between the electrode and the barrel interior surface to machine a plurality of circumferentially spaced longitudinally extending slots in the interior surface of the barrel.

A slow-wave structure assembly is formed by securing a subassembly comprising a slow-wave structure and a plurality of longitudinally disposed electrically insulating support rods in contact with and circumferentially spaced about the outer surface of the slow-wave structure within a barrel which has been machined as described above with the support rods disposed within respective ones of the slots. The radially inwardly projecting portions of the barrel between the slots provide integral conductive loading for the slow-wave structure.

Additional objects, advantages, and characteristic features of the present invention will become readily apparent from the following detailed description of preferred embodiments of the invention when considered in conjunction with the accompanying drawings.

DETAILED DESCRIPTION OF THE INVENTION

Figure 1:
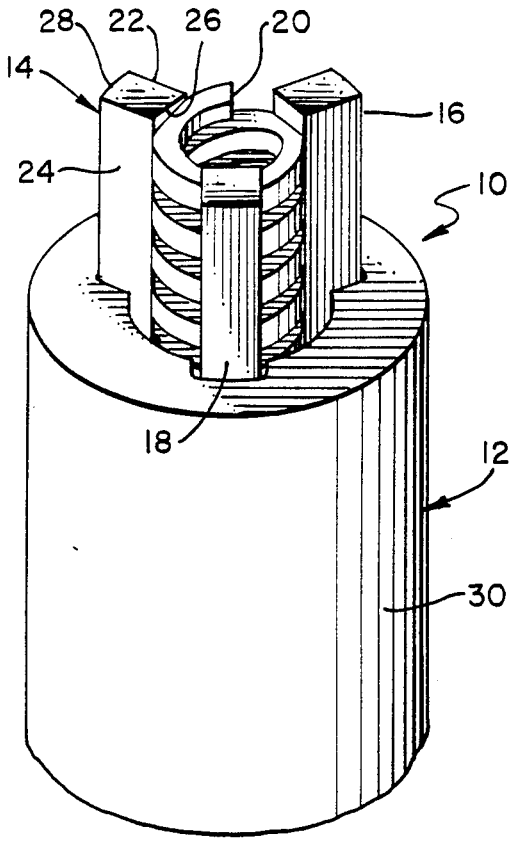
FIG. 1 is an exploded isometric view illustrating a slow-wave structure assembly according to the invention.
Figure 2:
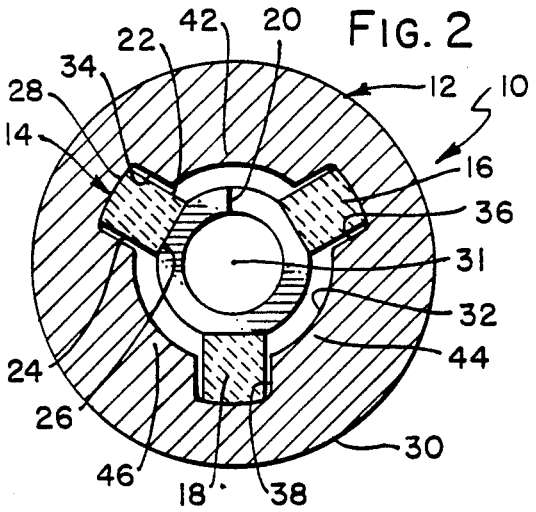
FIG. 2 is a sectional view through the slow-wave structure assembly of FIG. 1 taken in a plane transverse to the axis of the assembly.

As shown in FIGS. 1 and 2, slow-wave structure assembly 10 comprises a substantially tubular encasing barrel 12, electrically insulating support rods 14, 16 and 18, and electrically conductive slow-wave structure 20. Although the slow-wave structure 20 is illustrated as a single helix, other slow-wave structure configurations such as a bifilar helix or a ring-bar structure may be employed instead.

The support rods 14, 16 and 18, which may be of a ceramic material such as beryllia, support the slow-wave structure 20 within the barrel 12. Although three support rods are shown for illustrative purpose, other numbers of rods such as four are also suitable and may be employed. In the specific exemplary arrangement shown in FIGS. 1 and 2, the rods 14, 16 and 18 have flat radially extending sides 22 and 24 and inner circumferentially extending side 26. Outer circumferentially extending side 28 is curved slightly to more closely conform to the adjacent outer surface of the slow-wave structure 20 and thereby facilitate making good thermal contact therebetween. It is pointed out, however, that other rod cross-sectional configurations may be employed instead.

Barrel 12 has a cylindrical exterior surface 30 and a cylindrical interior surface 32 and is coaxially disposed about the slow-wave structure 20 along longitudinal axis 31 of the assembly 10. The diameter of the barrel interior surface 32 is greater than the outer diameter of the slow-wave structure 20 so that space exists between the slow-wave structure 20 and the barrel 12. The interior surface 32 defines a plurality (equal to the number of support rods for the slow-wave structure 10) of longitudinal slots 34, 36 and 38 extending throughout the length of the barrel 12.

Figure 3:
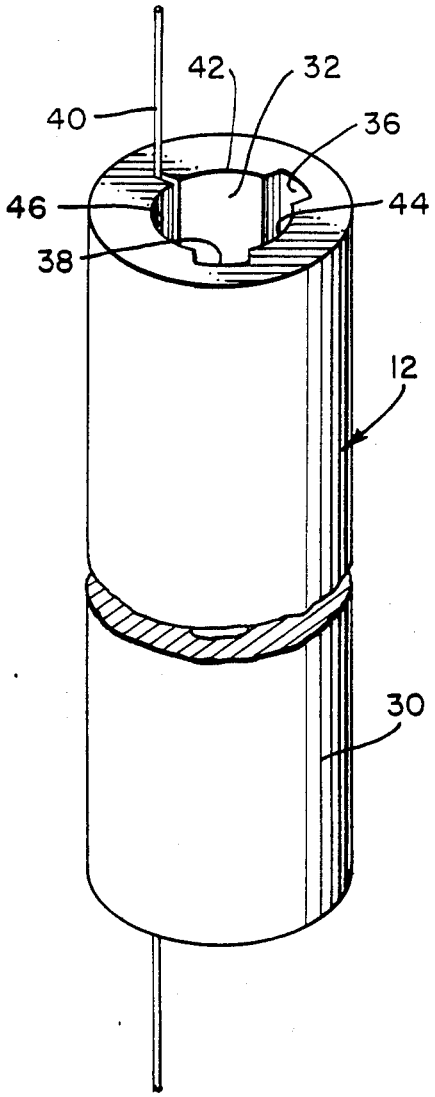
FIG. 3 is an isometric view, partly broken away and partly in section, showing the manufacture of a slow-wave structure encasing barrel in accordance with the invention.
Figure 4:
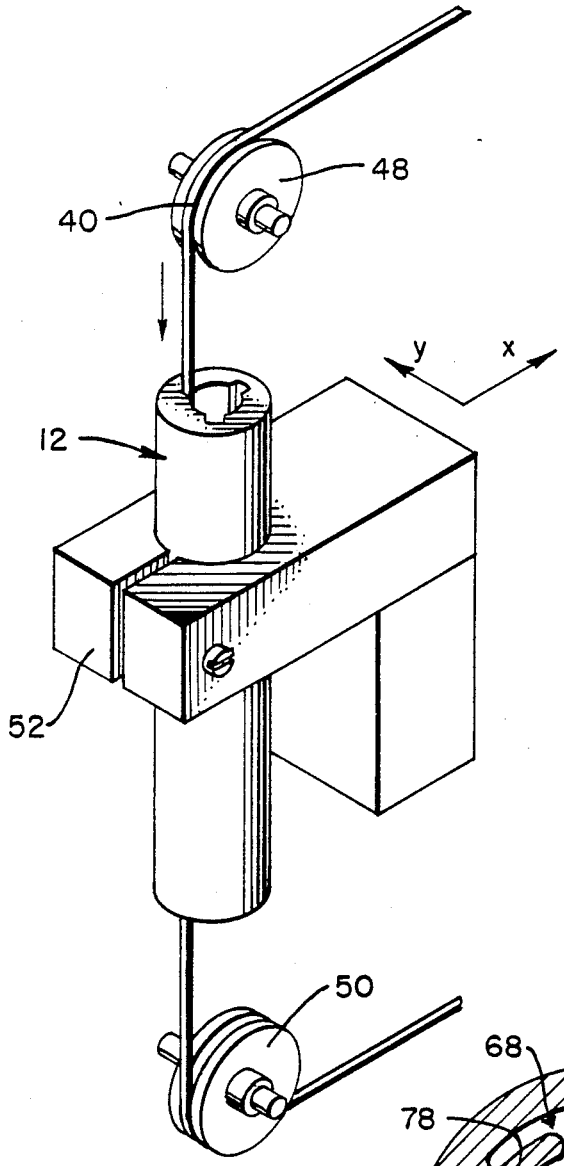
FIG. 4 is a perspective view showing a portion of electrical discharge machining apparatus used in the manufacture of the barrel of FIG. 3.

The slots 34, 36 and 38 preferably are formed by electrical discharge machining. As shown in FIGS. 3 and 4, an electrical discharge machining electrode wire 40 is moved longitudinally within the barrel 12 in close proximity to the interior surface 32 of the barrel 12. The electrical discharge occurs between the wire 40 and the barrel 12, which serves as the other electrode for the electrical discharge machine, thereby machining portions of the barrel 12 adjacent to the discharge region. Since adjacent portions of the wire 40 are also machined in the process, thereby reducing the cross-section of the wire 40, in order to maintain accurate machining the wire 40 is continually advanced over wire guides 48 and 50. The guides 48 and 50 permit accurate positioning of the wire 40 and advance it so that the portion thereof employed in the machining operation is of substantially full diameter. A suitable coolant is provided to maintain proper discharge conditions and remove machined-away particles.

As shown in FIG. 4, barrel 12 is mounted in clamp fixture 52, which in turn is mounted on a moveable table which is computer-controlled for position, motion and speed in X and Y directions, which are preferably normal to each other and normal to the direction of movement of the wire 40 between its guides 48 and 50. By appropriate movement of the barrel 12 in the X-Y plane, together with appropriate feed of the wire 40, accurate and uniform machining of the barrel interior surface 32 in a desired pattern may be carried out.

In the exemplary embodiment shown in FIG. 2, each of the slots 34, 36 and 38 preferably has an outer circumferential surface, adapted to be contacted by respective ones of the support rods 14, 16 and 18, which is curved to conform to the curvature of the outer rod surface so as to provide a large contact area. The barrel material between slots 34, 36 and 38 defines respective arch-shaped radially inwardly projecting portions 42, 44 and 46. The radially inwardly projecting portions 42, 44 and 46 are integral with the barrel 12 and provide conductive loading for the slow-wave structure 20 which results in a more constant phase velocity vs. frequency characteristic for the slow-wave structure 20, thereby enabling a wide bandwith to be achieved.

As an example for illustrative purposes, a helical slow-wave structure 20 which may be constructed with an integral barrel 12 according to the present invention is suitable for a traveling-wave tube which operates at millimeter wave frequencies such as 20 to 40 gigahertz. As an example of the size of a slow-wave structure operable at these frequencies, the diameter of the barrel interior surface 32 may be about 0.050 inch. The barrel material may be OFHC copper to achieve good electrical and thermal conductivity.

Figure 5:
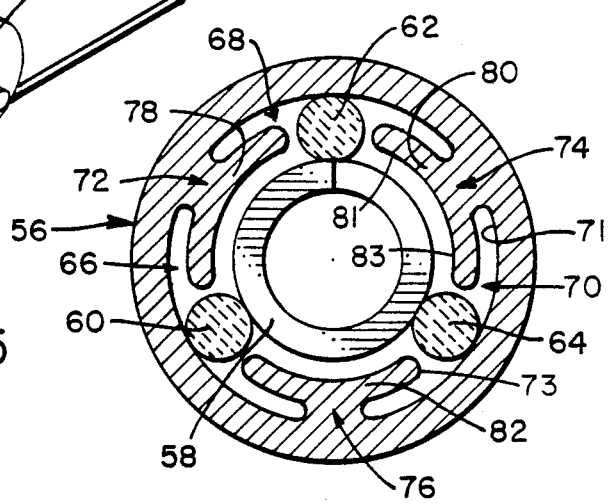
FIG. 5 is a sectional view similar to FIG. 2 illustrating a slow-wave structure assembly according to another embodiment of the invention.

In a further embodiment of the invention, illustrated in FIG. 5, barrel 56 is provided which is similar to the barrel 12 and contains therein a helical slow-wave structure 58. The slow-wave structure 58 is supported on three electrically insulating rods 60, 62 and 64 which, in turn, engage the outer circumferential surfaces of respective electrical discharge machined slots 66, 68 and 70 in the barrel 56. The slots 66, 68 and 70 each have a widened radially outer portion 71, which is substantially kidney-shaped, and a narrower radially inner neck portion 73.

In the embodiment of FIG. 5 the slots 66, 68 and 70 are separated by radially inwardly projecting portions 72, 74 and 76 which provide conductive loading for the slow-wave structure 58 and which define respective cap portions 78, 80 and 82 in their inner radial extremities. Each cap portion 78, 80 or 82 is configured in a pair of shelf portions 81 and 83 which circumferentially project over respective circumferentially outer regions of the radially outer portions 71 of the adjacent pair of slots 66, 68 and 70. The cap portions 78, 80 and 82 are arcuately curved so as to remain at a constant distance from the slow-wave structure 58, with the inner and outer circumferential surfaces of the slots 66, 68 and 70 being similarly curved.

In the exemplary embodiment shown in FIG. 5 the barrel 56 is machined to have three integral conductive loading portions 72, 74 and 76 with respective circumferentially projecting cap portions 78, 80 and 82. However, there may be more conductive loading portions than three, for example four or more, and their particular shapes may be tailored as desired. FIGS. 2 and 5 show examples of two different slow-wave structure assemblies formed according to the invention. Numerous other configurations are possible because of the versatility and accuracy of the electrical discharge machining process disclosed.

After the support rods 14, 16 and 18 and the slow-wave structure 20 have been manufactured, they are assembled in the barrel 12 with the rods 14, 16 and 18 lying in respective slots 34, 36 and 38 and the slow-wave structure centrally disposed between the rods 14, 16 and 18. In order to securely retain the assembly 10 together as a unit, the barrel 12 may brazed to the rods 14, 16 and 18 or, alternatively, may be coined around the rods 14, 16 and 18 and the slow-wave structure 20. The coining operation may be achieved by the method disclosed in U.S. Pat. No. 4,712,294 to Lee, the entire disclosure of which is incorporated herein by this reference. The same coining process may, of course, also be utilized with respect to the assembly 56 of FIG. 5. Once coined, the slow-wave structure assembly 10 or 56 is ready for insertion in a traveling-wave tube. The integral shield formed by the conductive loading portions 42, 44 and 46 of the barrel 12 or the conductive loading portions 72, 74 and 76 of the barrel 56 provide enhanced broadband performance for the traveling-wave tube.

Although the present invention has been shown and described with reference to particular embodiments, nevertheless, various changes and modifications which are obvious to a person skilled in the art to which the invention pertains are deemed to lie within the spirit, scope, and contemplation of the invention.

What is claimed is:

1. A method for forming an encasing barrel for a slow-wave structure comprising the steps of:
mounting an electrically conductive tubular barrel in electrical discharge machining apparatus;
positioning a machining electrode within said barrel; and
establishing an electrical discharge between said electrode and a portion of the interior surface of said barrel while providing relative movement between said electrode and said portion of said interior surface to machine a plurality of circumferentially spaced longitudinally extending slots in the interior surface of said barrel.

2. A method according to claim 1 wherein said machining electrode is a wire which is moved in a longitudinal direction within the interior of said tubular barrel while said electrical discharge is present.

3. A method according to claim 1 wherein said tubular barrel is moved in a preselected manner in a plane transverse to the axis of said barrel while said electrical discharge is present.

4. A method according to claim 1 wherein said electrode is a wire which is moved in a longitudinal direction within said tubular barrel while said barrel is moved in a preselected manner in a plane transverse to the direction of movement of said wire during the presence of said electrical discharge.

5. A method for forming a slow-wave structure assembly having an integral conductively-loaded encasing barrel comprising the steps of:
mounting an electrically conductive tubular barrel in electrical discharge machining apparatus;
positioning a machining electrode within said barrel;
establishing an electrical discharge between said electrode and a portion of the interior surface of said barrel while providing relative movement between said electrode and said portion of said interior surface to machine a plurality of circumferentially spaced longitudinally extending slots in the interior surface of said barrel; and
securing a subassembly comprising a slow-wave structure and a plurality of longitudinally disposed electrically insulating support rods in contact with the outer surface of said slow-wave structure and circumferentially spaced thereabout within the machined barrel with said support rods disposed within respective ones of said slots, whereby the radially inwardly projecting portions of said barrel between said slots provide integral conductive loading for said slow-wave structure.

6. A method for forming a slow-wave structure assembly having an integral conductively-loaded encasing barrel comprising the steps of:
electrical discharge machining a plurality of circumferentially spaced longitudinally extending slots in the interior surface of a tubular electrically conductive barrel; and
securing a subassembly comprising a slow-wave structure and a plurality of longitudinally disposed electrically insulating support rods in contact with the outer surface of said slow-wave structure and circumferentially spaced thereabout within said barrel with said support rods disposed within respective ones of said slots, whereby the radially inwardly projecting portions of said barrel between said slots provide integral conductive loading for said slow-wave structure.

7. A slow-wave structure assembly having an integral conductively-loaded encasing barrel comprising:
a slow-wave structure;
a plurality of longitudinally disposed electrically insulating support rods in rigid contact with the outer surface of said slow-wave structure and circumferentially spaced thereabout; and
a tubular barrel of electrically conductive material coaxially disposed about said rods and said slow-wave structure, said barrel defining a plurality of circumferentially spaced longitudinally extending slots along its interior surface for rigidly receiving respective ones of said rods, the radially inwardly projecting portions of said barrel between said slots comprising a widened radially outer portion of substantially kidney shape and a narrower radially inner portion and, thereby providing integral conductive loading for said slow-wave structure.

8. A slow-wave structure assembly having an integral conductively-loaded encasing barrel comprising:
a slow-wave structure;
a plurality of longitudinally disposed electrically insulating support rods in rigid contact with the outer surface of said slow-wave structure and circumferentially spaced thereabout; and
a tubular barrel of electrically conductive material coaxially disposed about said rods and said slow-wave structure, said barrel defining a plurality of circumferentially spaced longitudinally extending slots along its interior surface for rigidly receiving respective ones of said rods, the radially inwardly projecting portions of said barrel between said slots defining at least one shelf portion circumferentially projecting over a radially outer portion of one of said slots and thereby providing integral conductive loading for said slot-wave structure.

9. A slow-wave structure assembly having an integral conductively-loaded encasing barrel comprising:
a slow-wave structure;
a plurality of longitudinally disposed electrically insulating support rods in rigid contact with the outer surface of said slow-wave structure and circumferentially spaced thereabout; and
a tubular barrel of electrically conductive material coaxially disposed about said rods and said slow-wave structure, said barrel defining a plurality of circumferentially spaced longitudinally extending slots along its interior surface for rigidly receiving respective ones of said rods, the radially inwardly projecting portions of said barrel between said slots comprising a pair of shelf portions circumferentially projecting over respective portions of the radially outer portions of the adjacent pair of said slots and thereby providing integral conductive loading for said slow-wave structure.

* * * * *